United States Patent [19]

Stowell et al.

[11] 4,108,691

[45] Aug. 22, 1978

[54] ALUMINIUM BASE ALLOYS

[75] Inventors: Michael James Stowell, Saffron Walden; Brian Michael Watts, Kedington, both of England

[73] Assignee: T.I. (Group Services) Limited, Edgbaston, England

[21] Appl. No.: 736,745

[22] Filed: Oct. 28, 1976

[30] Foreign Application Priority Data

Oct. 29, 1975 [GB] United Kingdom ..... 44672/75

[51] Int. Cl.[2] ..... C22F 1/04

[52] U.S. Cl. ..... 148/11.5 A; 72/365; 72/377; 75/140; 75/141; 75/142; 75/146; 75/147; 148/32

[58] Field of Search ..... 75/147, 146, 140, 141, 75/142; 148/32, 32.5, 11.5 A, 2; 29/527.7; 72/365, 377

[56] References Cited

U.S. PATENT DOCUMENTS

| | | | |
|---|---|---|---|
| 1,870,732 | 8/1932 | Iytaka | 75/147 |
| 2,628,899 | 2/1953 | Willmore | 75/147 |
| 3,945,860 | 3/1976 | Winter et al. | 148/11.5 A |

*Primary Examiner*—R. Dean

*Attorney, Agent, or Firm*—Karl W. Flocks

[57] ABSTRACT

A superplastically deformable aluminium base alloy contains 2–8.5% by weight of magnesium and 0.4–1% by weight chromium. It may also contain minor alloying elements.

10 Claims, No Drawings

ALUMINIUM BASE ALLOYS

This application relates to aluminium base alloys capable of being formed or shaped into objects by superplastic deformation.

It is known that certain alloys under certain conditions can undergo very large amounts of deformation without failure, the phenomenon being known as superplasticity and characterised by a high strain rate sensitivity index in the material as a result of which the normal tendency of a stretched specimen to undergo preferential local deformation ("necking") is suppressed. Such large deformations are moreover possible at relatively low stresses so that the forming or shaping of superplastic alloys can be performed more simply and cheaply than is possible with even highly ductile materials which do not exhibit the phenomenon. As a convenient numerical criterion of the presence of superplasticity, it may be taken that a superplastic material will show a strain rate sensitivity ("m"-value) of at least 0.3 and a uniaxial tensile elongation at temperatures of at least 200%, "m"-value being defined by the relationship $\sigma = \eta\dot{\epsilon}^m$ where $\sigma$ represents flow stress, $\eta$ a constant, $\dot{\epsilon}$ strain rate and $m$ strain rate sensitivity index.

In British Pat. No. 1,387,586 there is proposed a superplastically deformable aluminium-base alloy selected from non heat-treatable aluminium-base alloys containing at least 5% Mg or at lease 1% Zn and heat-treatable aluminium-base alloys containing one or more of the elements Cu, Mg, Zn, Si, Li and Mn in known combinations and quantities, and at least one of the elements Zr, Nb, Ta and Ni in a total amount of at least 0.30% substantially all of which is present in solid solution, said total amount not exceeding 0.80%, the remainder being normal impurities and incidental elements known to be incorporated in the said aluminium-base alloys.

Attempts have been made to induce superplasticity in the conventional non heat-treatable alloys containing from 1–5% Mg by addition of the above-mentioned elements but without success; it was found that the alloys had to contain at least 5% magnesium. Furthermore, attempts were made to use chromium as an alternative to zirconium in order to induce superplastic behaviour in Al-6% Cu alloys but without success.

We have now found that it is possible to render low alloyed non heat-treatable alloys of the Al-Mg type superplastic by addition of chromium in an amount of at least 0.4%, whereby there may be produced in the alloy in the course of processing a stable finely divided dispersed phase which performs in these alloys a similar function to that of the phase $ZrAl_3$ which is believed to be formed in the preferred compositions mentioned in U.S. Pat. No. 1,387,586. This dispersed phase is believed to contain both magnesium and chromium and to have the composition $Mg_3Cr_2Al_{18}$.

Thus according to one aspect of the present invention a superplastically deformable aluminium alloy contains 2–8.5% by weight Mg and 0.4–1% by weight Cr together with optional minor alloying elements and normal impurities. The preferred minimum Mg content is 2.5%.

Desirably the alloy contains 3–5% Mg and 0.5–0.8% Cr.

Minor elements which may be added with benefit or at least tolerated include Zn, Mn, Cu, Ni, Si, Ti, B, Be. Of these elements, the amounts of Zn, Mn, Cu, Ni and Si preferably do not exceed 0.5% individually or 1.0% in total. The amounts of Ti, B and Be preferably do not exceed 0.2% individually or 0.3% in total. These elements may be added to achieve advantageous properties which are not related to the superplastic behaviour of the alloy.

Small amounts of other elements such as Sn, Bi and Pb and Sb may be added to improve etching behaviour, e.g. in amounts up to 0.3% individually or 0.5% in total.

In order that the finely divided dispersed phase shall be formed during processing after casting it is desirable that the original cast alloy, which may be in the form of a cast ingot, shall contain a substantial amount of chromium in solid solution, but whereas with the preferred alloys of U.S. Pat. No. 1,387,586 it is necessary to cast from high temperatures (e.g. 825°–900° C), this inconvenience can be avoided with the alloys of the present invention. Similarly, although the alloy is preferably solidified quickly, the block thickness that can be cast is less restricted by the need to achieve rapid solidification than in the case of the zirconium bearing alloys of British Pat. No. 1,387,586.

The dispersed phase containing magnesium and chromium may be formed during the superplastic forming operation. However for best results it is desirable to precipitate a proportion of the dissolved chromium as a fine dispersion of chromium bearing intermetallic compound prior to the superplastic forming operation and this may advantageously be done by initial hot and cold working, preferably with application of a controlled annealing treatment at a suitable stage in the working cycle. A preferred procedure comprises hot reduction followed by cold reduction, heat treatment and rolling to the required gauge. Preferably the alloy is subjected to at least 30% deformation during cold deformation and annealed at 350°–500° C; most preferred conditions are 50% deformation during cold deformation and an annealing temperature of 400°–470° C.

The invention will be illustrated by the following Examples.

EXAMPLE 1

Aluminium alloy laboratory samples containing the constituents shown in Table 1 below were cast at 750°–800° C, cold rolled, aged for 8 hours at 450° C and then hot rolled from 450° C and subjected to tests at a deformation rate of 0.05 in/min. The results obtained, and the testing temperature are shown in Table 1.

It can be seen from these results that all alloys A–E are superplastic.

TABLE 1

| Alloy | Composition % Mg | Composition % Cr | "m"-value (where determined) | Maximum elongation % | Testing Temperature ° C |
|---|---|---|---|---|---|
| A | 2.5 | 0.42 | — | 207 | 520 |
| B | 5.0 | 0.35 | — | 408 | 510 |
| C | 5.0 | 0.40 | 0.5 | 357 | 520 |
| D | 7.6 | 0.90 | — | 523 | 520 |
| E | 8.4 | 0.78 | 0.5 | 407 | 520 |

EXAMPLE 2

An aluminium alloy containing 5% by weight Mg and 0.5% by weight Cr was cast from 800° C. The casting was hot reduced to 50% deformation from 450° C followed by cross-rolling to gauge.

The product was tested as in Example 1 and an elongation of 341% was obtained at a testing temperature of 550° C.

We claim:

1. A method of preparing a superplastically deformable aluminium base alloy, in which an aluminium alloy consisting essentially of aluminum and from 2 to 8.5% by weight magnesium and from 0.4 to 1% chromium together with optional minor alloying elements and normal impurities is subjected to hot and cold plastic deformation whereby there is produced in the alloy a stable finely dispersed phase comprising aluminum magnesium and chromium.

2. A method according to claim 1, in which the alloy is annealed after hot and cold deformation and then subjected to further cold deformation.

3. A method according to claim 1, in which the alloy is subjected to at least 30% deformation during said cold deformation and is then annealed at a temperature from 350° to 500° C.

4. A method according to claim 3, in which the alloy is subjected to 50% deformation during said cold deformation and annealed at a temperature from 400° to 470° C.

5. The superplastically deformable aluminium base alloy produced by the process of claim 1.

6. An alloy according to claim 5 in which the magnesium content is at least 2.5% by weight.

7. An alloy according to claim 5 in which the magnesium content is 3–5% by weight and the chromium content 0.5–0.8% by weight.

8. An alloy according to claim 5, in which said minor alloying elements include one or more of Zn, Mn, Cu, Ni and Si in individual amounts of up to 0.5% by weight individually and in a total amount not exceeding 1.0% by weight.

9. An alloy according to claim 5, in which said minor alloying elements include one or more of Ti, B and Be in individual amounts of up to 0.2% individually and in a total amount not exceeding 0.3% by weight.

10. An alloy according to claim 5, in which said minor alloying elements include one or more of Sn, Bi, Pb and Sb in individual amounts of up to 0.3% by weight and in a total amount not exceeding 0.5% by weight.

* * * * *